United States Patent [19]

Walgamuth

[11] Patent Number: 4,996,807

[45] Date of Patent: Mar. 5, 1991

[54] MOBILE HOME SKIRT ANCHOR

[75] Inventor: Terry L. Walgamuth, Akron, Ind.

[73] Assignee: Akron Concrete Products, Inc., Akron, Ind.

[21] Appl. No.: 522,315

[22] Filed: May 11, 1990

[51] Int. Cl.[5] ..... B60R 27/00

[52] U.S. Cl. ..... 52/169.12; 52/DIG. 3

[58] Field of Search ..... 52/169.12, DIG. 3, 312, 52/242, 239

[56] References Cited

U.S. PATENT DOCUMENTS

| | | | |
|---|---|---|---|
| 3,803,781 | 4/1974 | Struben | 52/169.12 X |
| 4,352,261 | 10/1982 | Wargo | 52/169.12 |
| 4,805,301 | 2/1989 | Mason et al. | 52/169.12 |

*Primary Examiner*—David A. Scherbel
*Assistant Examiner*—Creighton Smith
*Attorney, Agent, or Firm*—Woodard, Emhardt, Naughton, Moriarty & McNett

[57] ABSTRACT

A mobile skirt anchor. A plurality of concrete anchors are partially buried in-ground with each anchor having an upwardly opening channel to lockingly receive the downwardly extending mobile home skirt. Each anchor includes outwardly extending eyebolts which mate with eyebolts of an adjacent anchor with the eyebolts secured together by means of a rod interlocking adjacent anchors together deterring animals from tunneling beneath the skirt.

18 Claims, 2 Drawing Sheets

MOBILE HOME SKIRT ANCHOR

BACKGROUND OF THE INVENTION

1. Field of the Invention

This invention is in the field of devices for securing suspended walls to the ground.

2. Description of the Prior Art

Mobile homes include skirts suspended therefrom which conceal the undercarriage and foundation while providing an appearance of permanency when a mobile home is located at its resident location. Typically, the skirt extends down to ground level. As a result, animals including rodents dig beneath the skirt thereby obtaining access to the location beneath the mobile home.

Mobile home skirts generally have a height of 3 feet and are constructed of multiple adjacent panels of relatively thin material. As a result, the skirts do not provide a weather-tight enclosure allowing wind and rain to blow through adjacent skirt panels. Further, the bottom portion of the skirt may sustain damage as a result of power trimmers used in landscaping.

Disclosed herein is a concrete anchor partially having a bottom portion buried in the ground and a top portion to releasably receive the bottom portion of the skirt. The anchor deters animals from tunneling beneath the skirt while at the same time securely holding the bottom portion of the skirt minimizing wind and rain passing between adjacent skirt panels. Since the bottom portion of the skirt is concealed within the concrete anchor, the prior damage from power trimmers is alleviated.

SUMMARY OF THE INVENTION

An anchoring system for a mobile home skirt including a plurality of concrete elongated members each having a main body with a first end and an opposite second end, the main body including a lower portion to be buried in ground and an upper portion extending upwardly above ground, the main body including a upwardly opening channel formed in concrete in the upper portion into which a mobile home skirt may extend anchoring the mobile home skirt to ground, first fasteners on the first end, second fasteners on the second end, and a device operable to releasably lock the first fasteners to the second fasteners when the members are positioned end to end with the first end of one member positioned adjacent the second end of an adjacent member.

It is an object of the present invention to provide means for anchoring mobile home skirts.

It is a further object of the present invention to provide a mobile home skirt holder limiting passage of wind and rain to beneath the mobile home.

Yet a further object of the present invention is to provide a new and improved anchor for mobile home skirts.

Related objects and advantages of the present invention will be apparent from the following description.

DESCRIPTION OF THE PREFERRED EMBODIMENT

Figure 1:
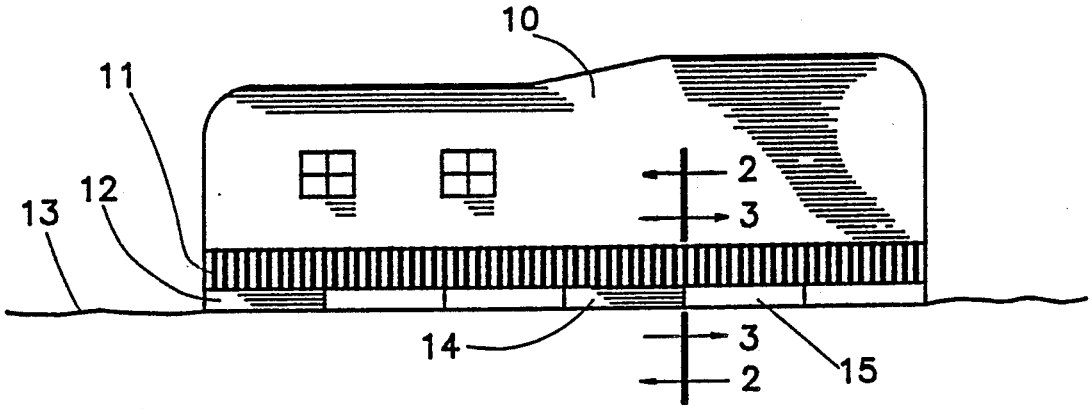
FIG. 1 is a side view of a mobile home with a skirt anchor incorporating the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
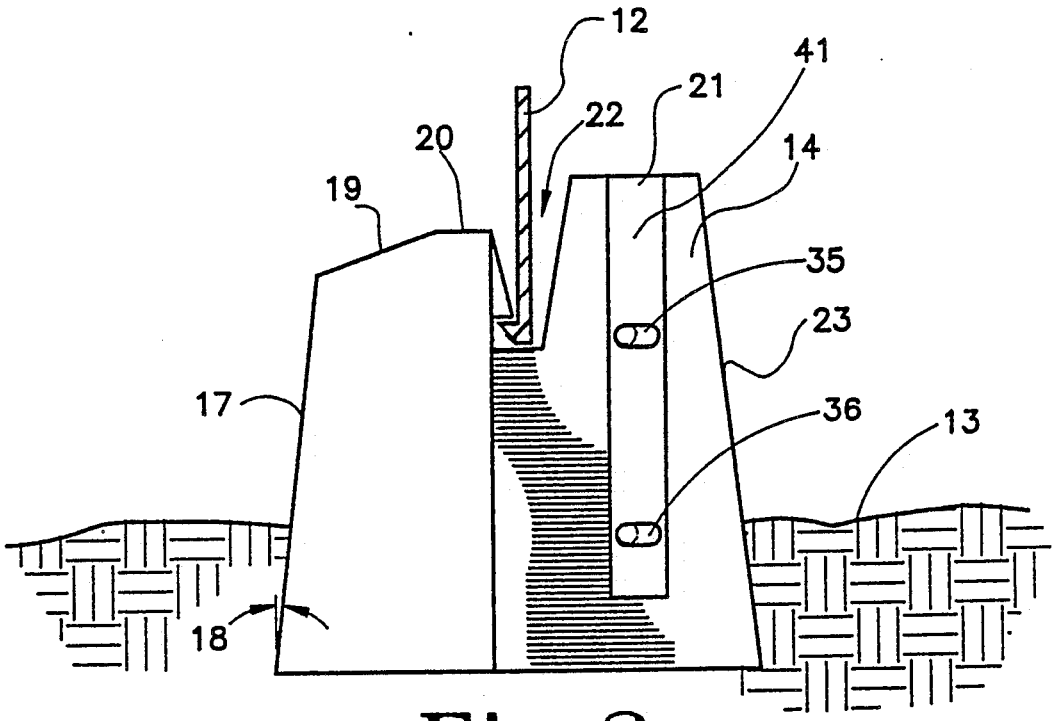
FIG. 2 is an enlarged cross-sectional view taken along a line and viewed in the direction of arrows 2—2 of FIG. 1.
Figure 3:
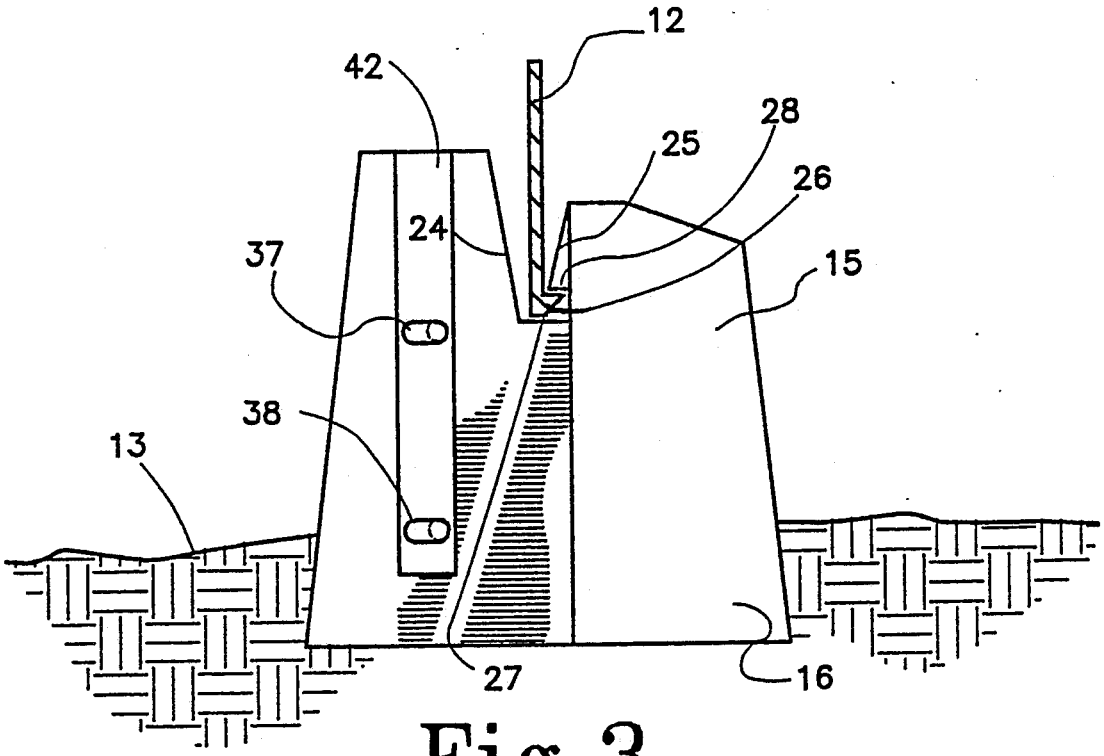
FIG. 3 is an enlarged cross-sectional view taken along a line and viewed in the direction of arrows 3—3 of FIG. 1.

Referring now more particularly to FIG. 1, there is shown a mobile home 10 having a conventional skirt 11 extending downwardly therefrom and concealing the undercarriage and foundation for the mobile home. Skirt 11 is composed of a plurality of individual skirts or skirt sections having their top edges fixedly secured to the mobile home with the skirts arranged to extend around the perimeter of the mobile home. The bottom ends of the individual skirts are releasably held by a plurality of concrete anchors 12 having bottom ends buried in ground 13. Concrete anchors 12 are identical with two such anchors 14 and 15 shown in FIG. 2 and 3.

Each anchor has a bottom portion 16 located beneath ground level 13 deterring access of rodents and other animals to the area immediately beneath the mobile home. Each anchor has an outwardly looking front face 17 arranged at an angle 18 to the vertical and terminating in a beveled top portion 19 and terminating at a short horizontal top surface 20. A rear horizontal surface 21 parallel to surface 20 is spaced apart by skirt channel 22 which releasably receives skirt 12. The rear surface 23 extends upwardly to horizontal surface 21 and is arranged at the same absolute angle 18 relative to the vertical.

Channel 22 extends the length of each anchor and is formed by a pair of converging surfaces 24 and 25 extending respectively from horizontal surfaces 21 and 20 down to an enlarged cavity 26. Skirt 12 includes a vertical main sheet body with a forwardly extending bottom edge portion 27. The skirt bottom 27 extends into a cavity 26 with the upper shoulder 28 of cavity 26 limiting upward movement of the bottom portion 27 of the skirt. In order to remove the skirt from channel 22 the top end of the skirt is first unfastened from the mobile home with the skirt then being moved rearwardly within cavity 26 until bottom end 27 clears shoulder 28 allowing the skirt to be pulled upwardly.

Figure 4:
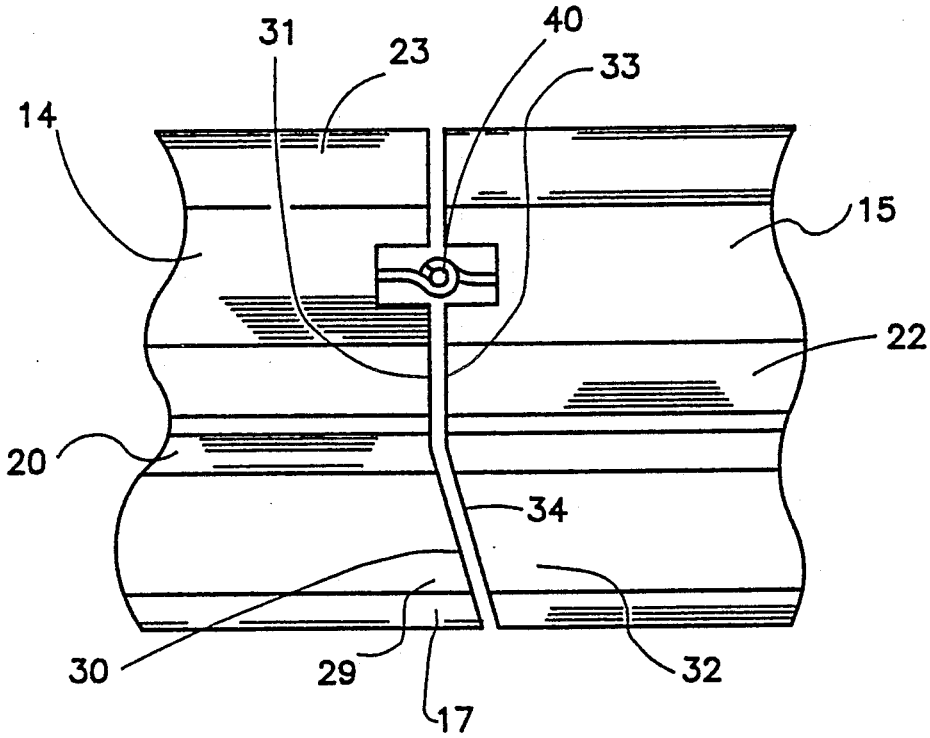
FIG. 4 is an enlarged fragmentary top view of adjacent anchors secured together with the skirt removed.

Each anchor has a pair of opposite ends with one end forming an irregular shaped recess and the opposite anchor end forming an irregular shaped projection complimentary to the recess. Thus, end 29 (FIG. 4) of anchor 14 forms an irregular shaped recess consisting of a planer surface 30 extending from the front surface 17 of the anchor to a second planer surface 31 extending from the rear surface 23 of the anchor. Surfaces 30 and 31 terminate along a vertical line positioned beneath horizontal surface 20. End 32 of anchor 15 is positioned adjacent and into the recess formed by end 29 of anchor 14 limiting relative motion between the two anchors. End 32 is formed by a pair of planer surfaces 33 and 34 which extend respectively from the rear surface and front surface of anchor 15 and terminate along a vertical line immediately beneath surface 20. The end of anchor 14 opposite end 29 has a shape identical to end 32 of anchor 15. Likewise, the end of anchor 15 opposite of end 32 of anchor 15 is configured identical to end 29 of anchor 14 allowing the anchors to be positioned in adjacent and interlocking relationship.

Each anchor end includes a pair of eyebolts cantileverly mounted thereto which extend adjacent corresponding eyebolts projecting outwardly from the adjacent anchor allowing a vertical rod to be extended through the mating eyebolts thereby locking adjacent anchors together. Thus, anchor 14 includes a pair of eyebolts 35 and 36 which extend outwardly from planer surface 31. Likewise, anchor 15 includes a pair of eyebolts 37 and 38 which extend outwardly from planer surface 33. Eyebolts 35 and 36 are positioned closer to the top of the anchor as compared to the positioning of eyebolts 37 and 38 allowing eyebolt 35 to be positioned over but adjacent eyebolt 37 and eyebolt 36 to be positioned above but adjacent eyebolt 38. Eyebolts 35 and 36 extend cantileverly outward from a channel 41 FIG. 2 formed in surface 31 of anchor 14. Likewise, eyebolts 37 and 38 extend cantileverly out from a similar channel 42 formed in surface 33 of anchor 15 allowing the two anchors to be placed close together. Similar eyebolts are provided at the opposite ends of anchors 14 and 15 to allow interconnection with the anchors adjacent to anchors 14 and 15. Rod 40 may take the form of a headed rod such as a gutter nail.

Many variations are contemplated and included in the anchors shown in the drawings. For example a right angle anchor may be utilized beneath the corner of the mobile home. In such a case, the anchor is identical to anchors 14 and 15 which the exception that the main body of the anchor is formed at a right angle. Thus, channel 22 likewise forms a right angle immediately beneath the corner of the mobile home. The opposite ends of the right angle anchor are configured identical to that depicted in the drawings for anchors 14 and 15. The anchors may be produced in varying lengths. Excellent results have been obtained by utilizing anchors having a length of 2 feet, 3 feet, and 5 feet.

The anchor disclosed herein is a unique footer system solving a multitude of problems inherent with mobile home skirting. The anchor includes a plurality of interlocking concrete components which are partially buried in a level shallow trench providing a footer to lock and hold virtually any type of skirting materials or sections. By being buried underground, the varmint and rodent problem is reduced because the concrete will deter animals from digging. Skirting sections are securely anchored into place to form a solid wrap for the base of any mobile home. Locking sections into the solid base provides a more weather tight enclosure plus makes skirting basically windproof. The anchor is ideal for eroded or unlevel ground conditions. The exposed concrete surface is unaffected by power trimmers and leaves a clean uniform foundation creating a perfect border for grooming or adjoining to landscaping. Further, the anchors unique interlocking/fastening concept restricts horizontal and vertical movement to a minimum while making assembly and installation a snap. A special lip in a J-shaped channel 22 accepts the locking tabs on skirting sections and secures the skirts in place.

In the event it is necessary to move the mobile home, the anchor footer system is as mobile as the home. With very little effort, the entire assembly can be excavated, disassembled and cleaned to be ready for moving and installing at the new site. In addition, the anchor provides a complete maintenance free anchoring system for mobile home skirting. The opposite ends of the anchors as well as the interlocking eyebolts are cooperatively operable to align the anchors in a horizontally extending row.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An anchoring system for a mobile home skirt comprising:

a plurality of concrete elongated members each having a main body with a first end and an opposite second end, said main body including a lower portion to be buried in ground and an upper portion extending upwardly above ground, said main body including a upwardly opening channel formed in concrete in said upper portion into which a mobile home skirt may extended anchoring said mobile home skirt to ground; and, first extension means on said first end;

second extension means on said second end; and, locking means operable to releasably lock said first extension means to said second extension means when said members are positioned end to end with said first end of one member positioned adjacent said second end of an adjacent member.

2. The anchoring system of claim 1 wherein:

said first extension means, said second extension means and said locking means are cooperatively operable to align said members in a horizontally extending row.

3. The anchoring system of claim 2 wherein:

said main body includes an upwardly facing surface interrupted by said channel which opens therethrough forming a forward upwardly facing surface and a rearward upwardly facing surface.

4. The anchoring system of claim 3 wherein:

said first extension means includes a first pair of arms extending outwardly from said first end, said second extension means includes a second pair of arms extending outwardly from said second end with said first pair of arms located vertically offset from said second pair of arms to position said first pair of arms and said second pair of arms extending between adjacent members in an overlapping relationship.

5. The anchoring system of claim 4 wherein:

said locking means includes a rod removably extendable through said first pair of arms and said second pair of arms to lock adjacent members together 6. The anchoring system of claim 5 wherein:

said channel has an enlarged bottom cavity and a narrow passage leading upwardly therefrom allowing a skirt to extend through said passage to said cavity.

7. The anchoring system of claim 6 wherein:

said first pair of arms and said second pair of arms each have curl shaped distal ends forming vertically aligned holes through which said rod extends.

8. The anchoring system of claim 4 wherein:

said first end is recessed and said second end projects outwardly complementary to said first end allowing a first end of one member to mate with a second end of an adjacent member.

9. The anchoring system of claim 4 wherein:

said first end and said second end each includes a recess in which is located respectively said first pair of arms and said second pair of arms.

10. A mobile home construction comprising:

a mobile home with a depending skirt with an enlarged bottom end positioned above ground;

a plurality of concrete anchors partially buried in ground limiting rodent passage and extending beneath and aligned with said skirt, each of said anchors include an upwardly opening channel integrally formed in concrete removably receiving said enlarged bottom end of said skirt to anchor said skirt to ground; and, locking means operable to releasably lock said concrete anchors together when said concrete anchors are positioned end to end.

11. The construction of claim 10 wherein:

said locking means includes a first pair of arms and a second pair of arms extending outwardly from opposite ends of said anchors with said first pair of arms located vertically offset from said second pair of arms to position said first pair of arms in an overlapping relationship with said second pair of arms between adjacent anchors.

12. The construction of claim 11 wherein:

said locking means further includes a rod removably extendable through said first pair of arms and said second pair of arms to lock adjacent anchors together.

13. The construction of claim 12 wherein:

said first pair of arms and said second pair of arms each have curl shaped distal ends forming vertically aligned holes through which said rod extends.

14. The construction of claim 13 wherein:

one of said opposite ends is recessed and one of said opposite ends projects outwardly in complementary fashion allowing adjacent anchors to mate together, said ends each include additional recesses in which are located said first pair of arms and said second pair of arms.

15. A skirting footer system for anchoring a skirt on a mobile home comprising:

a plurality of concrete footers partially buried in ground to limit rodent passage and extending beneath and aligned with said skirt, each of said footers include an upwardly opening channel integrally formed in concrete removably receiving said skirt to secure said skirt to ground; and, locking means operable to releasably lock said concrete footers together when said concrete footers are positioned end to end.

16. The skirting footer system of claim 15 wherein:

said locking means includes a first pair of arms and a second pair of arms extending outwardly from opposite ends of said footers with said first pair of arms located vertically offset from said second pair of arms to position said first pair of arms in an overlapping relationship with said second pair of arms between adjacent footers.

17. The skirting footer system of claim 16 wherein:

said locking means further includes a rod removably extendable through said first pair of arms and said second pair of arms to lock adjacent footers together.

18. The skirting footer system of claim 17 wherein:

each of said footers include a plurality of inwardly located concrete surfaces forming said channel with said concrete surfaces defining an enlarged cavity and a passage leading upwardly therefrom allowing said skirt to extend through said passage to releasably lock said skirt in said enlarged cavity.

* * * * *